US006272896B1

(12) United States Patent
Ho

(10) Patent No.: US 6,272,896 B1
(45) Date of Patent: Aug. 14, 2001

(54) SECONDARY (BACK-UP) ROLLER DESIGN FOR THE FILLET ROLLING OF THE CRANKSHAFT

(75) Inventor: Hsin-Chung Ho, Ann Arbor, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/471,771

(22) Filed: Dec. 23, 1999

(51) Int. Cl.[7] ..... B21D 15/00
(52) U.S. Cl. ..... 72/110; 72/107; 29/6.01
(58) Field of Search ..... 72/107, 110; 29/6.01, 29/888.08; 384/568, 569

(56) References Cited

U.S. PATENT DOCUMENTS

| | | | | |
|---|---|---|---|---|
| 2,841,861 | | 7/1958 | Williams . | |
| 2,876,528 | | 3/1959 | Wulpi . | |
| 3,735,620 | | 5/1973 | Naumann . | |
| 4,299,017 | | 11/1981 | Gottschalk . | |
| 4,531,394 | * | 7/1985 | Turley et al. | 72/238 |
| 4,559,798 | | 12/1985 | Hayashi et al. . | |
| 4,747,285 | | 5/1988 | Berstein et al. . | |
| 4,802,775 | * | 2/1989 | Takata | 384/568 |
| 4,811,585 | | 3/1989 | Takahashi et al. . | |
| 4,870,845 | | 10/1989 | Nakagawa . | |
| 5,445,003 | | 8/1995 | Gottschalk et al. . | |
| 5,493,761 | | 2/1996 | Bone . | |
| 5,495,738 | | 3/1996 | Gottschalk . | |
| 5,575,167 | | 11/1996 | Gottschalk et al. . | |
| 6,094,956 | * | 8/2000 | Vodopyanov et al. | 72/110 |

* cited by examiner

*Primary Examiner*—Ed Tolan
(74) *Attorney, Agent, or Firm*—Mark P. Calcaterra

(57) ABSTRACT

The present invention provides a metal working device for cold working fillets which includes an upper block journally supporting a primary roller and a secondary roller. The primary roller has a rounded outer contact surface and the secondary roller has a concave mating surface. A portion of the concave mating surface is rollingly engaged with a portion of the outer contact surface along a predetermined contact area. The predetermined contact area is greater than 90 degrees. A support area is also provided which rollingly supports the object to allow the metal working device to cold work the fillets. Lastly, a pressure supplying device supplies pressure to the upper block to provide the required pressure to cold work the fillets.

7 Claims, 4 Drawing Sheets

SECONDARY (BACK-UP) ROLLER DESIGN FOR THE FILLET ROLLING OF THE CRANKSHAFT

FIELD OF THE INVENTION

The present invention relates generally to a secondary roller design for a fillet rolling device and, more particularly, to a secondary roller design for a fillet rolling device which improves the wear characteristics of the primary roller.

BACKGROUND OF THE INVENTION

Cold working is an operation performed on metal components to increase the strength characteristics of that metal component. This operation involves plastically deforming critical portions of the metal component, thereby changing the grain structure therein. This type of operation is commonly used on corner areas of metal components. Such corner areas typically act as stress risers, thereby cracking under extreme loads. The cold working process acts to plastically deform these cornered areas, otherwise known as fillets, to increase the strength characteristics of the particular location.

In crankshaft design, a crankshaft typically has a plurality of fillets located along various points of the crankshaft periphery. Under engine loads, these fillets act as stress risers and if not properly treated, can result in cracking of the crankshaft. As such, typical manufacturers utilize a cold working process on the fillet radii to enhance their strength characteristics. This cold working process typically utilizes a pair of primary rollers which physically contact and deform the fillet radii. To obtain the required force for plastic deformation of the fillet radii, a secondary roller is provided which maintains physical contact and pressure against the primary rollers. This pressure drives the primary rollers into the fillet radii, and thereby plastically deforms the fillet radii.

While this method provides adequate work hardening of the fillet radii, drawbacks exists in regards to the wear characteristics of the primary and secondary rollers. More specifically, the extreme amount of force required by the primary rollers to cause plastic deformation can result in extreme wear between and primary and secondary rollers. This wear requires manufacturers to frequently replace the primary or secondary rollers. As a result, manufacturers are forced to shut down manufacturing lines and replace costly parts. The present invention was developed in light of this drawback.

SUMMARY OF THE INVENTION

It is therefore an object of the present invention to provide a metal working device for cold working fillets which has a primary and secondary roller design which reduces wear on the primary and secondary rollers.

The present invention provides a metal working device for cold working fillets which includes an upper block journally supporting a primary roller and a secondary roller. The primary roller has a rounded outer contact surface and the secondary roller has a concave mating surface. A portion of the concave mating surface is rollingly engaged with a portion of the outer contact surface along a predetermined contact area. The predetermined contact area is greater than 90 degrees. A support area is also provided which rollingly supports the object to allow the metal working device to cold work the fillets. Lastly, a pressure supplying device supplies pressure to the upper block to provide the required pressure to cold work the fillets.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
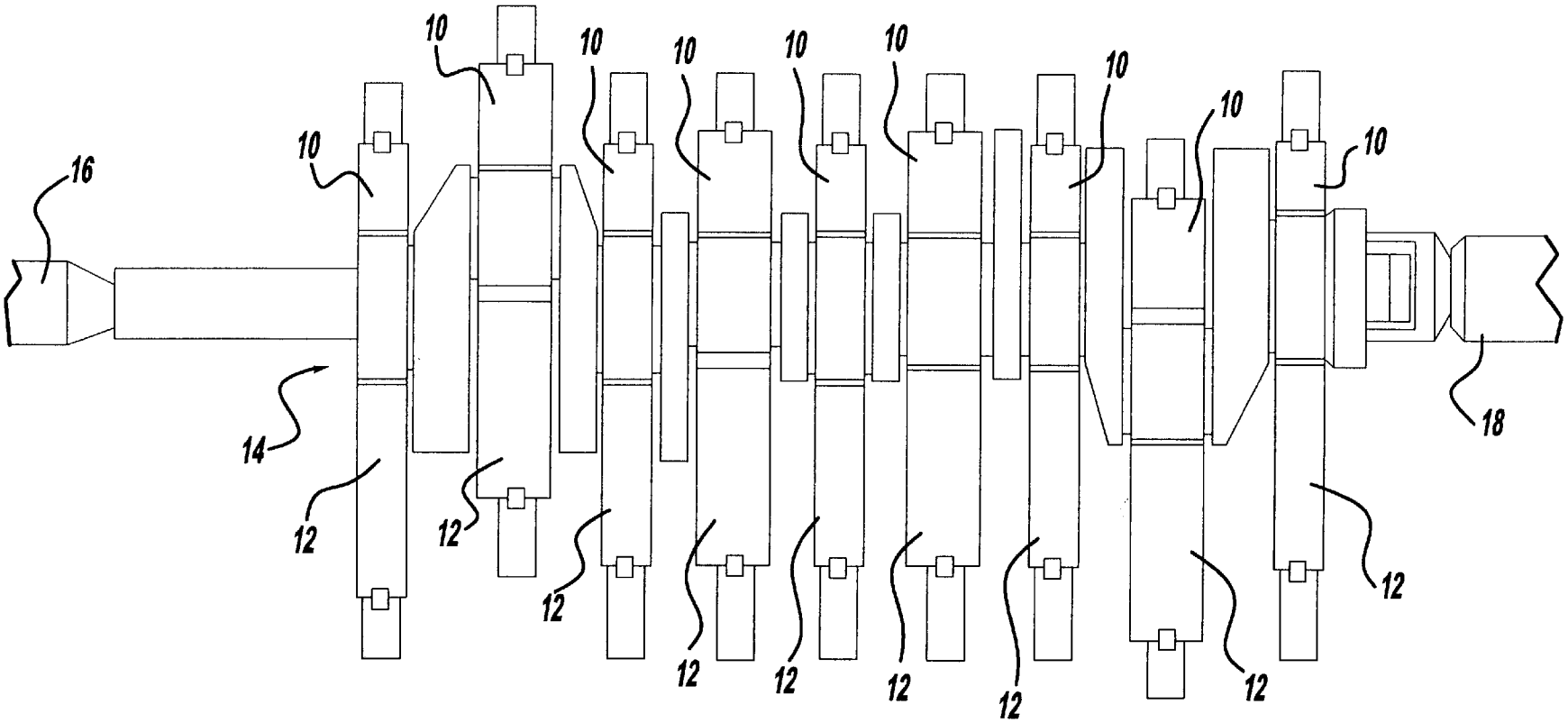
FIG. 1 is a schematic view of a fillet roller according to the present invention being used in conjunction with a crankshaft.

Referring now to FIG. 1, a plurality of metal working devices encompassing an upper block 10 and support area 12 are shown being used to cold work portions of crankshaft 14. Crankshaft 14, in turn, is journally supported by a first support 16 and a second support 18. First support 16 acts as merely a rotational guide, thereby allowing crankshaft 14 to rotate. Second support 18, alternatively, clamps to an outer diameter of crankshaft 14 and provides the required rotation of crankshaft 14.

Figure 2:
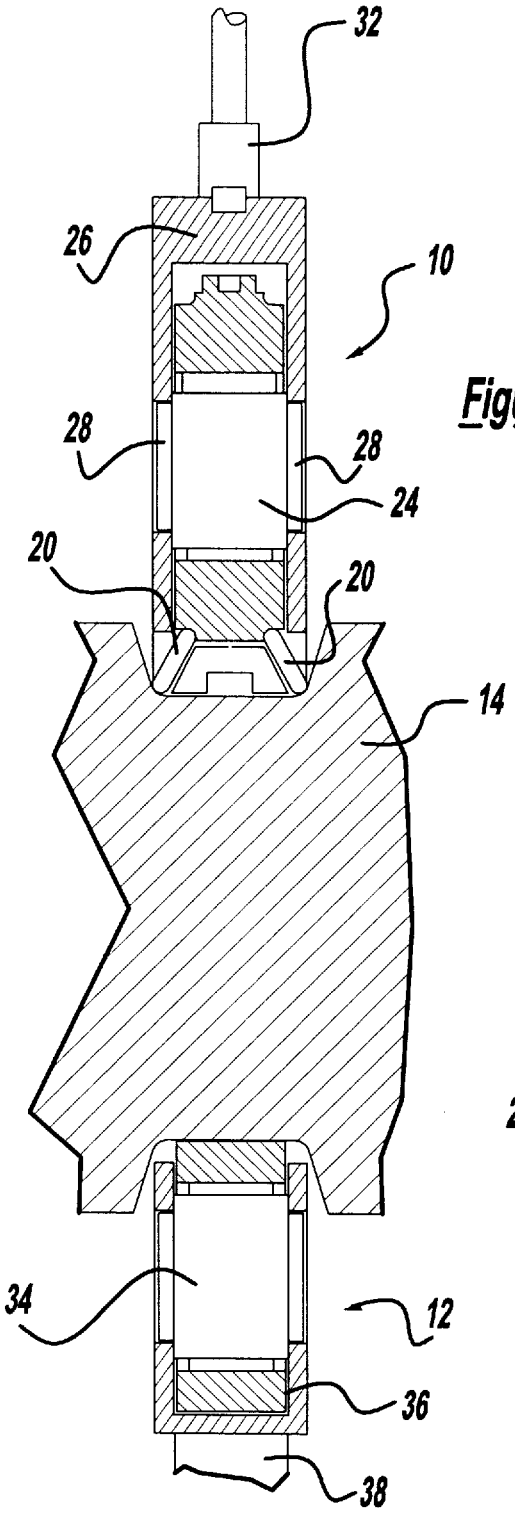
FIG. 2 is a cross-sectional view of a fillet roller according to the present invention being used in conjunction with a crankshaft.
Figure 3:
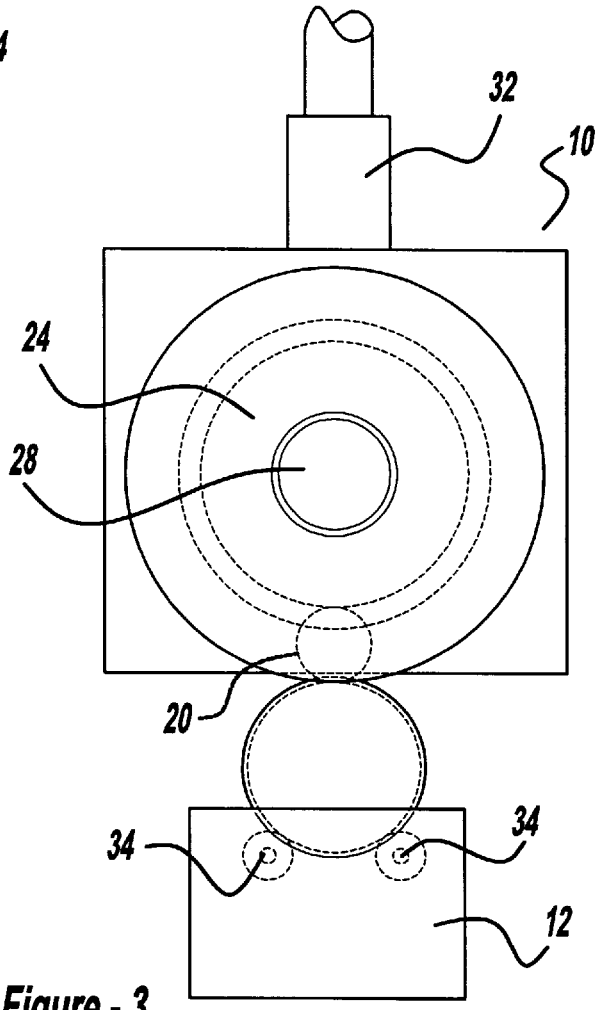
FIG. 3 is a cross-sectional view of a fillet roller according to the present invention being used in conjunction with a crankshaft.

Referring now to FIGS. 2 and 3, an upper block 10 and a support area 12 are shown in greater detail. Upper block 10 generally comprises a pair of primary rollers 20 in rolling engagement with a secondary roller 24. Secondary roller 24 is journally supported in housing 26 at journal supports 28. A pressure supplying device 32 is attached to an upper portion of upper block 10 for reasons which will be discussed. Support block 12 generally includes support roller 34 journally supported by housing 36. Support pressure supplying device 38 provides pressure to support block 12.

Figure 7:
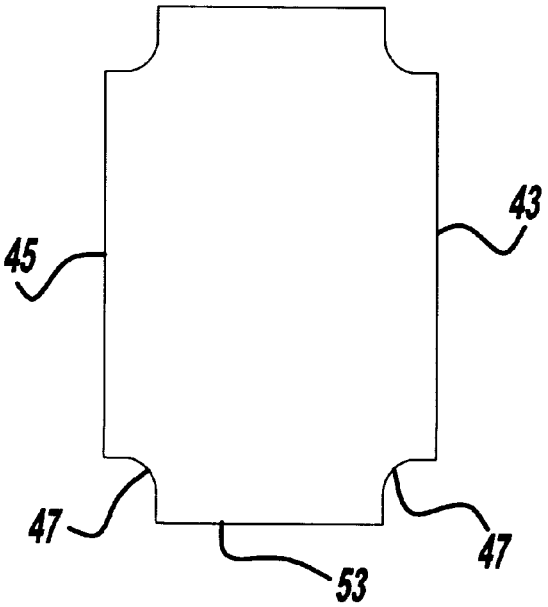
FIG. 7 is a cross-sectional view of a secondary roller for a fillet roller according to the present invention.

Referring to FIG. 7, secondary roller 24 is shown having a first side 43, a second side 45, and an outer surface 53. First side 43 and second side 45 are connected to outer surface 53 by first and second concave mating surfaces 47.

Figure 4A:
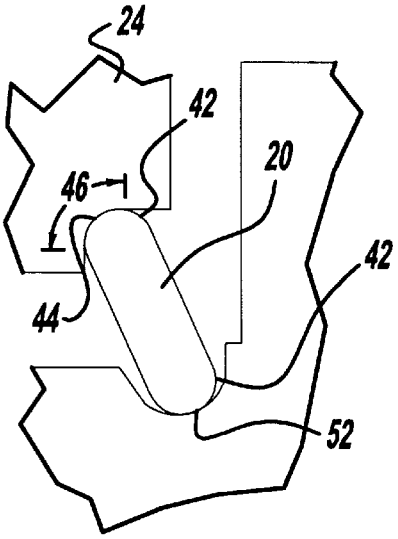
Figure - 4a Prior Art
FIG. 4*a* is a cross-sectional view of a primary and secondary roller of a fillet roller according to the prior art.
Figure 5A:
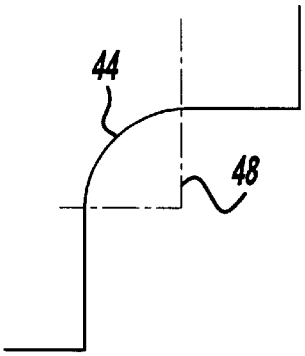
Figure - 5a Prior Art
FIG. 5*a* is a cross-sectional view of a primary roller and secondary roller for a fillet roller according to the prior art.

Referring now to FIGS. 4*a,* 4*b,* 5*a,* and 5*b,* a detailed description of primary rollers 20 and secondary rollers 24 are provided. In FIG. 4*a,* a primary-secondary roller configuration according to the prior art is shown. Here, primary roller 20 is shown having a rounded outer contact surface 42. Likewise, secondary roller 24 is shown having a concave mating surface 44. As shown in FIG. 5*a,* this concave mating surface extends along a 90 degree angle 48. As a result, rounded outer contact surface 42 is in contact with concave mating surface 44 along a predetermined contact surface extending along an angle 46. Contact surface 42 is used to cold work the fillet radius 52 of the crankshaft 14.

Figure 4B:
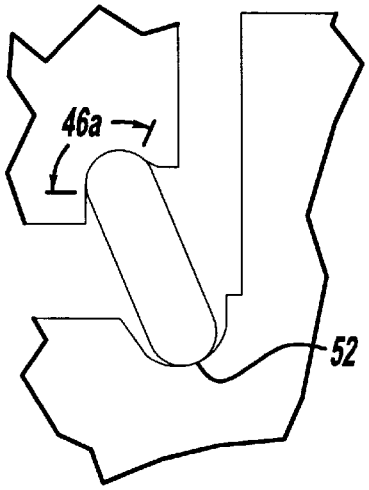
FIG. 4*b* is a cross-sectional view of a secondary roller for a fillet roller according to the present invention.
Figure 5B:
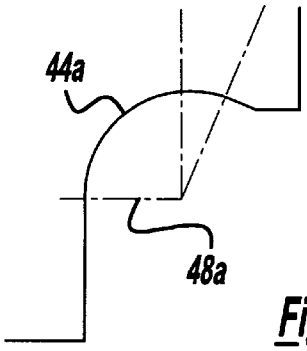
FIG. 5*b* is a cross-sectional view of a secondary roller for a fillet roller according to the present invention.

Referring now to FIGS. 4*b* and 5*b,* a primary-secondary roller relationship according to the present invention is shown and described.

As shown in FIG. 5*b,* the present invention provides a concave mating surface 44*a* which extends an angle 48*a* which is greater than 90 degrees. As a result, as shown in FIG. 4*b,* concave mating surface 44*a* abuts rounded outer contact surface 42 along a predetermined contact surface which extends an angle 46*a*. Because of the increased angle 48*a,* the angle 46*a* is greater than angle 46. Since the force exerted by pressure supplying device 32 is supplied over a greater predetermined contact surface 46*a,* the amount of pressure on each element of rounded outer contact surface 42 is proportionally reduced.

Figure 6:
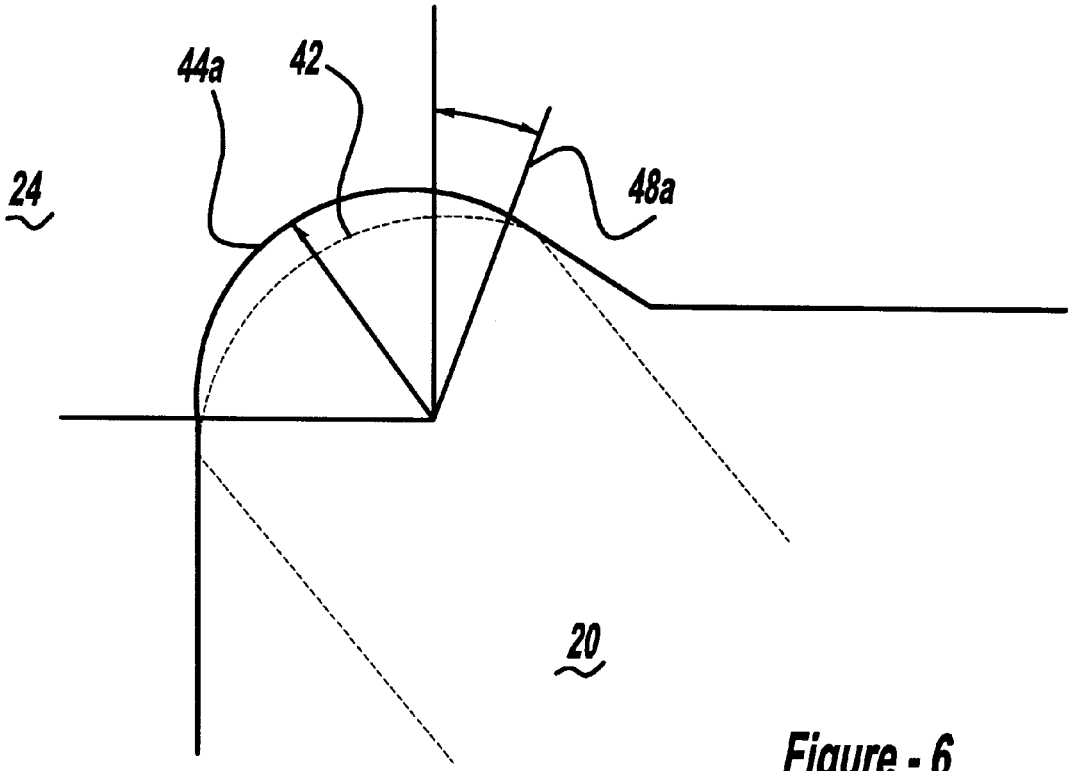
FIG. 6 is a cross-sectional view of a second embodiment of a primary roller and a secondary roller for a fillet roller according to the present invention.

Referring now to FIG. 6, a second embodiment of the present invention is described. In FIG. 6, secondary roller 24 is constructed of a material which is softer than primary roller 20. As shown in FIG. 6, the pressure supplied by pressure supplying device 32 causes the material of secondary roller 24 to deform and conform around outer contact surface 42 of the primary roller 20. Due to the high contact pressure developed at the concave mating surface 44*a* of the secondary rollers, the concave mating surface 44*a* of secondary roller 24 will both elastically and plastically deform to the larger contact regions of the outer contact surface 42. Increasing the loads on primary roller 20 and secondary rollers 24 increases the contact forces at the predetermined contact surface 46*a.* Since the contact surface 46*a* is larger than the contact surface 44 of the prior art (see FIG. 4*b*), the contact pressure at the rollers' mating surface of the present invention is smaller than that of prior art. As a result, the developed stress and strain on the primary and secondary rollers of the present invention are smaller than those on the primary and secondary rollers of the prior art.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A metal working device for cold working fillets of an object, said metal working device comprising:

an upper block journally supporting a primary roller and a secondary roller, said primary roller having a rounded outer contact surface, said secondary roller having a concave mating surface, said concave mating surface extending along an angle greater than 90 degrees, a portion of said concave mating surface rollingly engaged with a portion of said outer contact surface along a predetermined contact area;

a support area constructed to rollingly support said object to allow said metal working device to cold work said fillets; and a pressure supplying device selectively supplying pressure to said upper block to cold work said fillets.

2. A metal working device as claimed in claim 1, wherein a portion of said outer contact surface of said primary roller is rollingly engaged with said fillets of said object at a fillet area substantially opposite said predetermined contact area.

3. A metal working device as claimed in claim 2, wherein said fillet area is sized to accommodate fillets of a crankshaft.

4. A metal working device as claimed in claim 1, wherein said primary roller is rotatable about a first axis and said secondary roller is rotatable about a second axis, wherein said first axis is non-parallel with said second axis to angle said first axis upward to allow said primary roller to cold work fillets of a crankshaft.

5. A metal working device as claimed in claim 1, wherein said secondary roller has a first side opposite and spaced from a second side, said secondary roller having an outer face connected to said first side by said concave mating surface, said outer face being connected to said second side by a second concave mating surface, said second concave mating surface being greater than 90 degrees.

6. A metal working device as claimed in claim 5, further comprising a second primary roller journally supported by said upper block and having a second rounded outer contact surface, a portion of said second concave mating surface rollingly engaged with a portion of said second outer contact surface along a second predetermined contact area.

7. A metal working device as claimed in claim 1, wherein said object is a crankshaft.

* * * * *